US011181352B1

(12) United States Patent
Smitchko

(10) Patent No.: US 11,181,352 B1
(45) Date of Patent: Nov. 23, 2021

(54) FIREARM PROJECTILE

(71) Applicant: Daniel J. Smitchko, Morrisdale, PA (US)

(72) Inventor: Daniel J. Smitchko, Morrisdale, PA (US)

( * ) Notice: Subject to any disclaimer, the term of this patent is extended or adjusted under 35 U.S.C. 154(b) by 0 days.

(21) Appl. No.: 16/914,395

(22) Filed: Jun. 28, 2020

(51) Int. Cl.
*F42B 12/78* (2006.01)
*F42B 14/02* (2006.01)
*F42B 30/02* (2006.01)

(52) U.S. Cl.
CPC ..... *F42B 12/78* (2013.01); *F42B 14/02* (2013.01); *F42B 30/02* (2013.01)

(58) Field of Classification Search
CPC ..... F42B 12/78; F42B 14/02; F42B 30/02
USPC ..... 102/501
See application file for complete search history.

(56) References Cited

U.S. PATENT DOCUMENTS 2,120,913 A * 6/1938 Studler ..... F42B 14/064 102/516
2,928,348 A * 3/1960 Zisman ..... F42B 14/02 102/527
3,096,715 A * 7/1963 Dufour ..... F42B 12/06 102/518
3,677,181 A * 7/1972 Giljarhus ..... F42B 12/208 102/364
3,786,760 A * 1/1974 Feldmann ..... F42B 14/02 102/527
4,112,846 A * 9/1978 Gilbert ..... F42B 12/06 102/364
4,549,488 A * 10/1985 Hoffmann ..... F42B 10/34 102/503
4,850,278 A * 7/1989 Dinkha ..... F42B 8/16 102/501
6,237,497 B1 * 5/2001 Altenau ..... F42B 14/02 102/514
7,503,521 B2 * 3/2009 Maynard ..... F42B 12/40 244/3.16
2016/0033244 A1 * 2/2016 Minnicino, II ..... F42B 10/62 102/501
2016/0153757 A1 * 6/2016 Mahnke ..... F42B 12/74 102/501
2016/0327380 A1 * 11/2016 Kunz ..... F42B 10/44
2017/0089672 A1 * 3/2017 Burrow ..... F42B 12/745
2017/0115104 A1 * 4/2017 Peterson ..... F42B 14/02
2019/0113318 A1 * 4/2019 Taylor ..... F42B 10/38

* cited by examiner

*Primary Examiner* — Samir Abdosh
(74) *Attorney, Agent, or Firm* — John J. Elnitski, Jr.

(57) ABSTRACT

A projectile adapted for use with a cartridge in a firearm with a barrel. The projectile is of a .22 caliber. The projectile includes a body machined from a solid material having a rear end and forward end. The projectile includes a heel starting at the rear end. A crimp groove extends forward of the heel. An adjustable sealing band extends forward of the crimp groove. A pressure reducing groove extends forward of the rear driving band. A front driving band extends forward of the pressure reducing groove. An Ogive extends forward of the front driving band. Finally, there is a bullet tip extending forward of the Ogive. A specific version ment that has been found to be very accurate in the most amount of rifles has adjustable sealing band diameter of 0.224 inches, a pressure reducing groove diameter of 0.2165 inches and a front driving band diameter of 0.2213 inches.

20 Claims, 4 Drawing Sheets

FIREARM PROJECTILE

BACKGROUND

The present invention generally relates to firearm projectiles. More specifically, the present invention relates to .22 caliber rimfire bullets.

With the advent of laws restricting use of lead bullets and lead core jacket bullets, shooters are turning to the use of bullets machined from a solid material. Gyroscopic stability problems are associated with jacketed lead bullets due to the core of the bullet not being located at the true axis of rotation of the bullet, as compared to precision machined solid bullets. Some firearms include rifling within the barrel of the firearm. Rifling is a series of grooves cut into inside diameter of the barrel. The remaining material between the grooves is knows as the lands. The lands are what remain between the grooves after the grooves are cut in the inside diameter of a blank barrel. Lead and lead core jacketed bullets are designed to be slightly undersize due to swelling when the bullet is fired to seal into the groove diameter of a barrel of a firearm. Whereby, groove diameter is the largest diameter inside the barrel of the firearm.

The .22 caliber bullet commonly uses a heeled lead or lightly plated bullet. The nominal bullet diameter of the .22 caliber bullet is larger than the nominal bore diameter of a firearm to prevent fliers, or inaccuracies, that can occur when shooting lead bullets that are the same or slightly smaller than the groove diameter. SAAMI specifies a nominal bullet diameter of 0.2255 with a tolerance of −0.004, while the specified bore diameter is 0.222. In practice, 0.224 or slightly larger bullets are common, with barrel groove diameters commonly around 0.223. Having a heeled bullet means that the bullet is the same diameter as the cartridge case and has a narrower "heel" portion that fits in the cartridge case. The .22 Long Rifle cartridge is one of the few cartridges that are accepted by a large variety of rifles and handguns where the bullet diameter is in the range of 0.223 inches (5.7 mm)-0.2255 inches (5.73 mm).

Machining monolithic bullets from solid material instead of forging lead bullets requires different design criteria. Solid bullets cannot be shot in standard .22 caliber rimfire barrels if manufactured to the same OD tolerance as solid lead bullets are manufactured. Bullets machined from copper or a copper alloy are substantially harder than lead bullets and excess pressure occurs if made to the same diameter as the lead bullets. Therefore the OD must be made slightly smaller than the rifle barrels groove diameter. If the solid bullets are not "sealed" in the rifle grooves during firing, gasses escape around the bullet causing inaccuracies to be experience when using solid bullets in some guns. When there is no sealing between the solid bullet and the barrel there can also be loss of potential speed of the bullet as it leaves the barrel. Solid copper bullets do not upset or swell to fill the groove diameter. If there is any wear in the barrel or if the barrel is made slightly oversize due to the manufacturing process, blow by is experienced using solid copper bullets. Blow by is where pressure escapes around the bullet. That is why shooters using solid copper bullets in the past have not been able to shoot them consistently. Typically in shooting five solid copper bullets, you may get three or four with in a group and one or two that are not in the group of the other shots. On top of the difference between the design of lead based bullets versus solid bullets, .22 caliber rimfire bullets design is a different approach, then the typical centerfire caliber bullet. This is due to the cartridge case used and manufacturing process.

It is an object of the present invention to provide a .22 caliber rimfire bullet of a solid material that has improved accuracy.

SUMMARY OF THE INVENTION

A projectile adapted for use with a cartridge in a firearm with a barrel. The projectile is of a .22 caliber. The projectile includes a body machined from a solid material having a rear end and forward end. The projectile includes a heel starting at the rear end. A crimp groove extends forward of the heel. An adjustable sealing band extends forward of the crimp groove. A pressure reducing groove extends forward of the rear driving band. A front driving band extends forward of the pressure reducing groove. An Ogive extends forward of the front driving band. Finally, there is a bullet tip extending forward of the Ogive. A specific version that has been found to be very accurate in the most amount of rifles has adjustable sealing band diameter of 0.224 inches, a pressure reducing groove diameter of 0.2165 inches and a front driving band diameter of 0.2213 inches.

DETAILED DESCRIPTION

Figure 1:
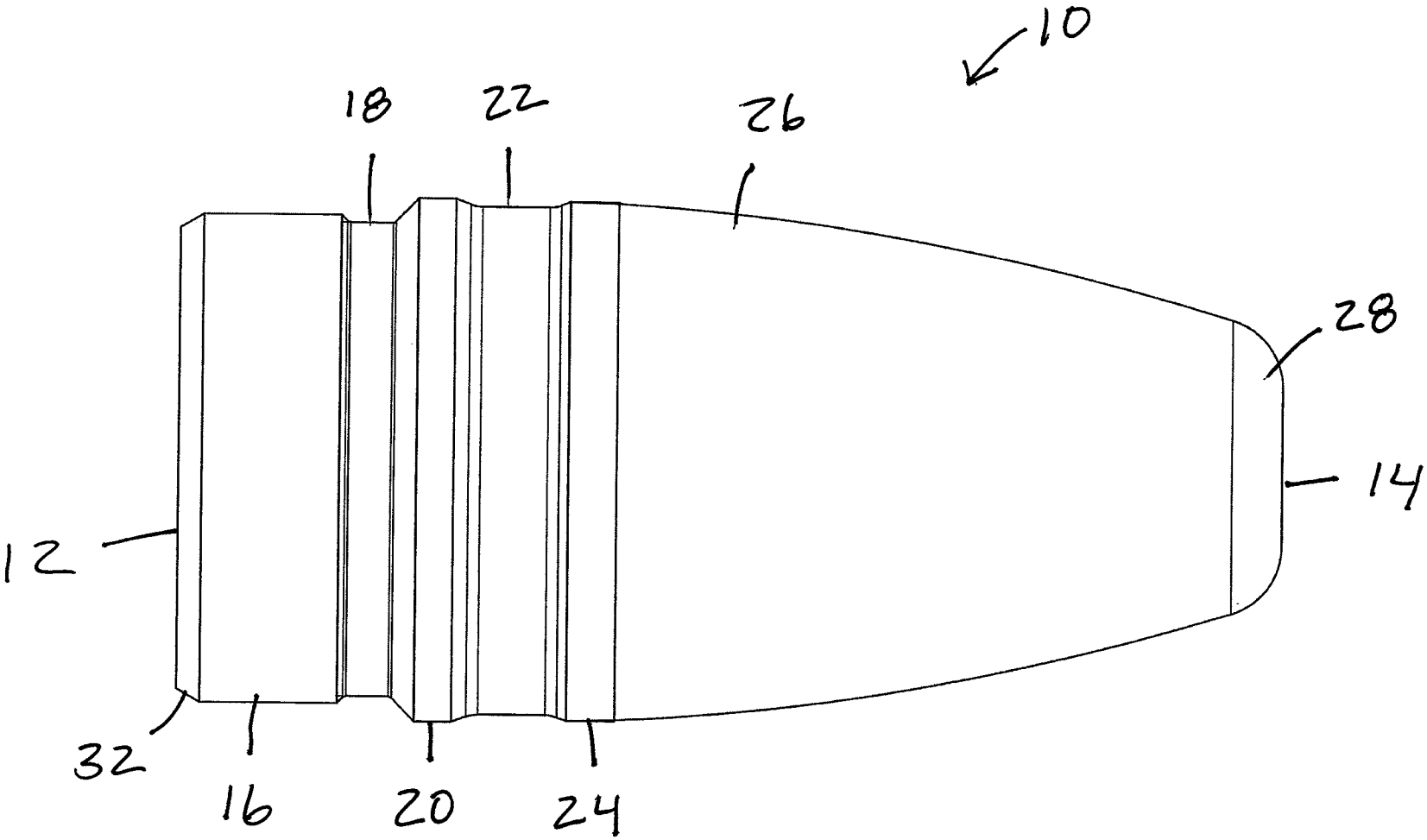
FIG. 1 is a profile view of a first embodiment projectile according to the present invention.
Figure 3:
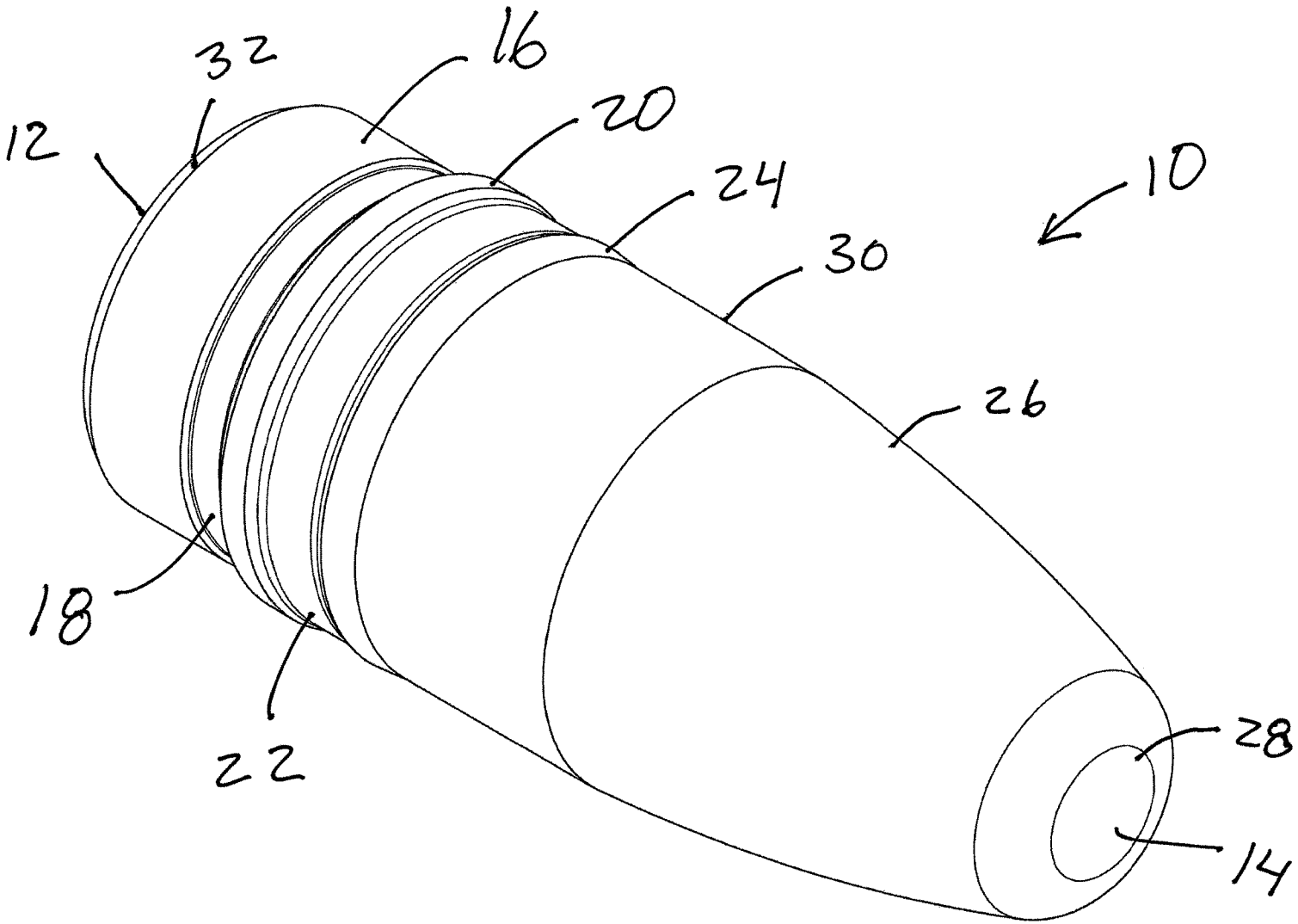
FIG. 3 is a perspective view of FIG. 2 according to the present invention.
Figure 4:
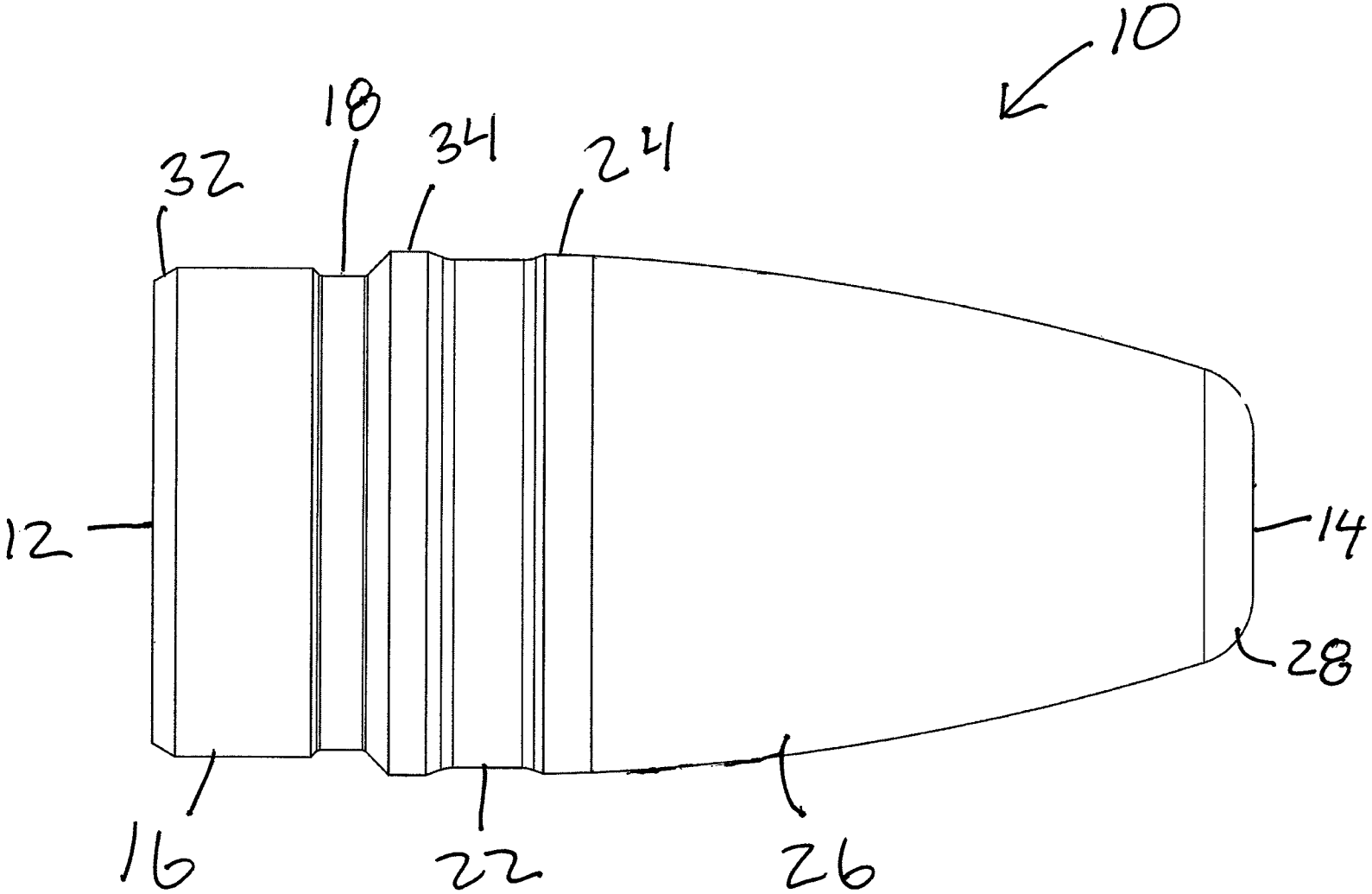
FIG. 4 is a profile view of a third embodiment projectile according to the present invention.

The present invention is a firearm projectile 10 for a firearm, commonly referred to as a bullet. The firearm projectile is of a monolithic construction, which is the precise machining of a bullet from a solid material such as copper. The bullet is manufactured by turning on a lathe or milling with a CNC machine. The caliber of the bullet is .22 caliber for a rimfire cartridge case. The projectile eliminates several problems associated with other solid bullet designs for the .22 caliber bullet, as well as problems associated with lead core jacketed bullets. FIG. 1 shows a first embodiment, FIGS. 2-3 shows a second embodiment and FIG. 4 shows a third embodiment.

FIG. 1 shows the profile of the first embodiment of the projectile 10 depicting the componential shapes of the first embodiment of the bullet. The projectile 10 includes a rear end 12 and a forward end 14. The components of the bullet profile starting from the rear 12 are a heel 16, crimp groove 18, rear driving band 20, pressure reducing groove 22, front driving band 24, Ogive 26 and bullet tip 28. The components of the bullet profile can be defined by a diameter and length, where length is a measurement between the front end 14 and the rear end 12 of the bullet profile. An optional bore rider 30 is also shown on FIG. 2. Due to the ductility and formable nature of the copper and copper alloys typically used for bullets, these materials allow deformation of the bullet during the process of firing. The pressure reducing groove 22 is for reducing the total length of the bearing surface and also provides an area to receive the transfer of any deformed material of the projectile 10 during the process of projecting the projectile 10 through a barrel of a firearm. The crimp groove 18 of the projectile 10 serves two purposes. The first purpose is that the crimp groove 18 is used in the process of crimping the case to the projectile 10. The second purpose is that the crimp grove 18 serves as a secondary area to receive deformed material of the projectile 10.

A chamfer 32 is at the rear end 12 as part of the heel 16. The chamfer 32 provides a starting place that is slightly smaller diameter than the heel 16 to ease insertion of the projectile 10 into the case. The heel 16 has a range of diameter of 0.205-0.209 inches and a length in a range of 0.069±0.015 inches. The heel 16 is the component of the profile of the projectile 10 that is inserted in the case to form a complete cartridge that is ready to be fired by a firearm. The crimp groove 18 is forward of the heel 16. The crimp groove 18 has a range of diameter of 0.200-0.208 inches and a length in a range of 0.034±0.025 inches. The rear driving band 20 is forward of the crimp groove 18. The rear driving band 20 has a range of diameter of 0.221-0.222 inches and a length in a range of 0.016±0.025 inches. The pressure reducing groove 22 is forward of the rear driving band 20. The pressure reducing groove 22 has a range of diameter of 0.210-0.221 inches and a length in a range of 0.051±0.025 inches. The front driving band 24 is forward of the pressure reducing groove 22. The front driving band 24 has a range of diameter of 0.219-0.222 inches and a length in a range of 0.020±0.015 inches. The Ogive 26 is forward of the front driving band 24 and the bullet tip 28 is at the front end 14 when the Ogive 26 ends. The Ogive 26 defined as the "curve of a bullet's forward section" and can be expressed as a tangent ogive or secant ogive. A bullet with a tangent Ogive is one that has the cylindrical surface of the bullet tangent, or blended smooth, to the body diameter of the bullet. A bullet with a secant Ogive is one that has the cylindrical surface of the bullet secant, or not blended smooth to the body of the bullet. The projectile is shown with a meplat as the bullet tip 28, which is defined as a flat or open tip on the front end 14 of a bullet. The bullet tip 28 of the projectile 10 can also end in a round nose, a sharp tip or point.

Figure 2:
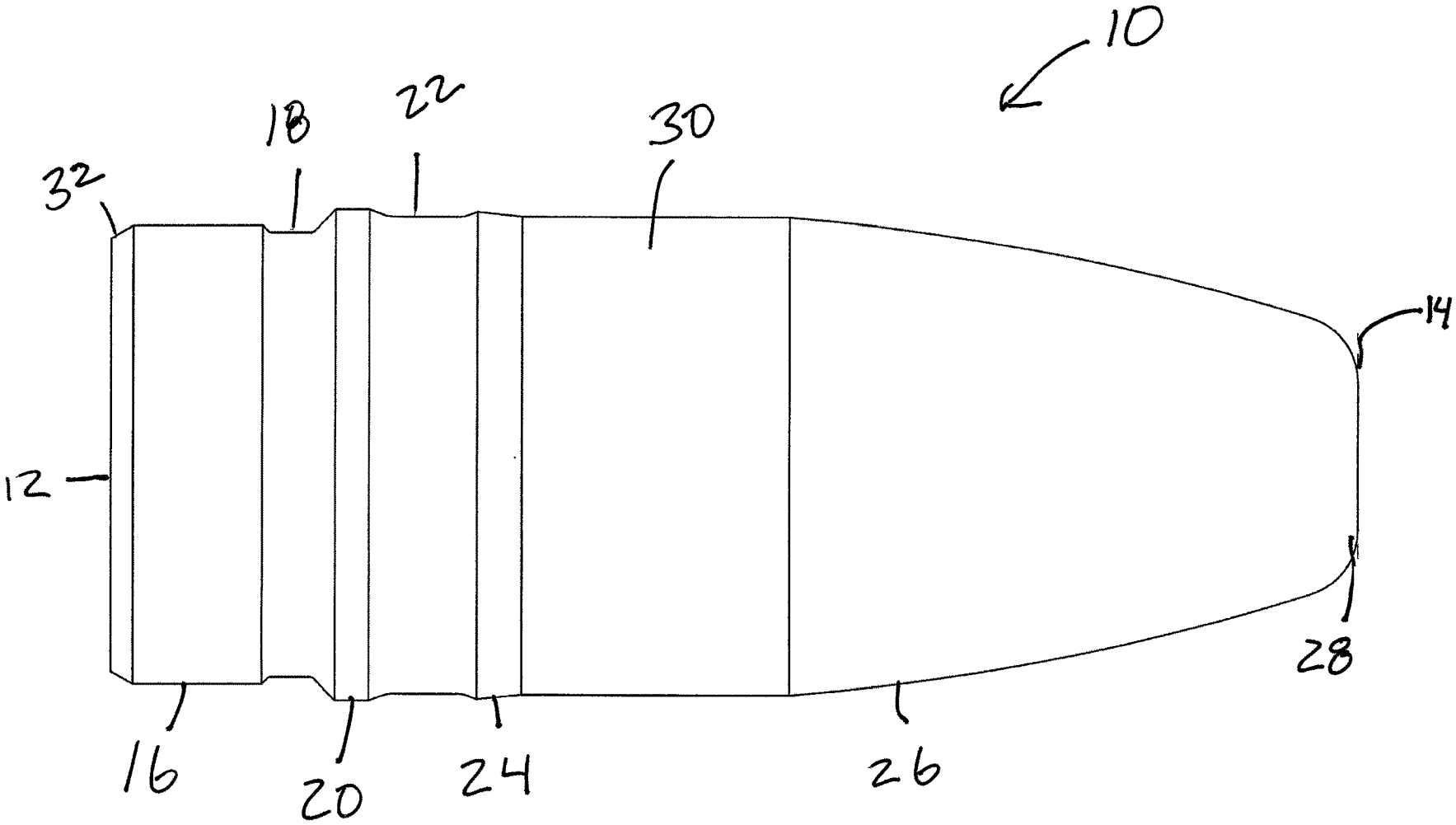
FIG. 2 is a profile view of a second embodiment projectile according to the present invention.

FIG. 2 shows the profile of the projectile 10 depicting the componential shapes of the second embodiment of the bullet. FIG. 3 shows a perspective view of FIG. 2. The profile of the projectile 10 in FIG. 2 is the same as FIG. 1, but includes a bore rider 30. A bore rider 30 is a section of the bullet where the diameter is that of the actual rifle barrels bore or slightly smaller which reduces the effective bearing surface length which in turn reduces pressures. The bore rider 30 is between the front driving band 24 and the Ogive 26. The bore rider has a range of diameter of 0.214-0.219 inches and a length in a range of 0.124±0.120 inches depending on bullet weight.

FIG. 4 shows the profile of the projectile 10 depicting the componential shapes of the third embodiment of the bullet. The profile of the projectile 10 in FIG. 4 is the same as FIG. 1, but replaces the rear driving band 20 with an adjustable sealing band 34. Due to the ductility and formable nature of the copper and copper alloys, these materials allow deformation of the adjustable sealing band, without causing excessive pressures or wear on the firearm. The adjustable sealing band 34 adjusts during firing by deforming. The adjustable sealing band 34 is larger than the driving band. The crimp groove 18 and pressure reducing groove 22 are each next to the adjustable sealing band 34 to receive part of the adjustable sealing band 34 when the adjustable sealing band 34 is deformed and also reduces the effective bearing surface length of the projectile 10. The adjustable sealing band 34 is used to eliminate the possibility the projectile 10 will not seal tightly in the barrel of the firearm. When the adjustable sealing band 34 contacts the inside surfaces of a firearm, the adjustable sealing band 34 deforms to fit tightly within the rifled barrel of the firearm and forms a seal between the projectile 10 and the rifled barrel. A rifled barrel includes lands and groove twisted through the barrel. The seal forms between the projectile 10 and the rifled barrel due to the deformation of the adjustable sealing band 34 and prevents the escape of gases from behind the projectile 10 during firing. The adjustable sealing band 34 will flow into both the crimp groove 18 and pressure reducing groove 22, as the adjustable sealing band 34 is compressed and deformed due to contact with the inside surfaces of the firearm. The adjustable sealing band 34 has a range of diameter of 0.222-0.226 inches and a length in a range of 0.016±0.020 inches. A specific version of the fourth embodiment that has been found to be very accurate in the most amount of rifles has adjustable sealing band diameter 34 of 0.224 inches, a pressure reducing groove 24 diameter of 0.2165 inches and a front driving band diameter 24 of 0.2213 inches. The third embodiment can include a bore rider 30 as described for the second embodiment.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

I claim:

1. A projectile adapted for use with a cartridge in a firearm with a barrel, consisting of:

a body machined from a solid material having a rear end and forward end;

a heel starting at said rear end;

a crimp groove forward of said heel;

an adjustable sealing band forward of said crimp groove, wherein there is no material receiving groove between said adjustable sealing band and said crimp groove;

a pressure reducing groove forward of said adjustable sealing band;

a front driving band forward of said pressure reducing groove, wherein there is no material receiving groove forward of said front driving band and wherein said adjustable sealing band and said front driving band share said pressure reducing groove between them;

an Ogive forward of said front driving band; and a bullet tip.

2. The projectile of claim 1, further including a bore rider between said front driving band and said Ogive.

3. The projectile of claim 1, wherein said body is machined from a copper material.

4. The projectile of claim 1, wherein said body is machined from a copper alloy material.

5. The projectile of claim 1, wherein said projectile is .22 caliber.

6. The projectile of claim 1, wherein said heel has a length in a range of 0.069±0.015 inches, said crimp groove a length in a range of 0.034±0.025 inches, said adjustable sealing band has a length in a range of 0.016±0.025 inches, said pressure reducing groove has a length in a range of 0.051±0.025 inches, said front driving band has a length in a range of 0.020±0.015 inches, and said bore rider has a length in a range of 0.124±0.120 inches.

7. The projectile of claim 6, further including a bore rider between said front driving band and said Ogive and said bore rider has a length in a range of 0.124±0.120 inches.

8. The projectile of claim 1, wherein said heel has a range of diameter of 0.205-0.209 inches, said crimp groove has a range of diameter of 0.200-0.208, said adjustable sealing band has a range of diameter of 0.222-0.226 inches, said pressure reducing groove has a range of diameter of 0.210-0.221 inches, and front driving band has a range of diameter of 0.219-0.222 inches.

9. The projectile of claim 7, wherein said adjustable sealing band has diameter of 0.224 inches, a pressure reducing groove has a diameter of 0.2165 inches and a front driving band has a diameter of 0.2213 inches.

10. The projectile of claim 6, wherein said heel has a range of diameter of 0.205-0.209 inches, said crimp groove has a range of diameter of 0.200-0.208, said adjustable sealing band has a range of diameter of 0.222-0.226 inches, said pressure reducing groove has a range of diameter of 0.210-0.221 inches, and front driving band has a range of diameter of 0.219-0.222 inches.

11. The projectile of claim 10, wherein said adjustable sealing band has diameter of 0.224 inches, a pressure reducing groove has a diameter of 0.2165 inches and a front driving band has a diameter of 0.2213 inches.

12. A projectile adapted for use with a cartridge in a firearm with a barrel, comprising:

a body machined from a solid material having a rear end and forward end;

a heel starting at said rear end;

a crimp groove forward of said heel;

a rear driving band forward of said crimp groove, wherein there is no material receiving groove between said rear driving band and said crimp groove;

a pressure reducing groove forward of said rear driving band;

a front driving band forward of said pressure reducing groove, wherein there is no material receiving groove forward of said front driving band and wherein said rear driving band and said front driving band share said pressure reducing groove between them;

an Ogive forward of said front driving band; and a bullet tip.

13. The projectile of claim 12, further including a bore rider between said front driving band and said Ogive.

14. The projectile of claim 12, wherein said projectile is .22 caliber.

15. The projectile of claim 12, wherein said heel has a length in a range of 0.069±0.015 inches, said crimp groove a length in a range of 0.034±0.025 inches, said rear driving band has a length in a range of 0.016±0.025 inches, said pressure reducing groove has a length in a range of 0.051±0.025 inches, said front driving band has a length in a range of 0.020±0.015 inches, and said bore rider has a length in a range of 0.124±0.120 inches.

16. The projectile of claim 15, further including a bore rider between said front driving band and said Ogive and said bore rider has a length in a range of 0.124±0.120 inches.

17. The projectile of claim 12, wherein said heel has a range of diameter of 0.205-0.209 inches, said crimp groove has a range of diameter of 0.200-0.208, said rear driving band has a range of diameter of 0.221-0.222 inches, said pressure reducing groove has a range of diameter of 0.210-0.221 inches, and front driving band has a range of diameter of 0.219-0.222 inches.

18. The projectile of claim 15, wherein said heel has a range of diameter of 0.205-0.209 inches, said crimp groove has a range of diameter of 0.200-0.208, said rear driving band has a range of diameter of 0.221-0.222 inches, said pressure reducing groove has a range of diameter of 0.210-0.221 inches, and front driving band has a range of diameter of 0.219-0.222 inches.

19. The projectile of claim 12, wherein said body is machined from a copper material.

20. The projectile of claim 12, wherein said body is machined from a copper alloy material.

* * * * *